US009194116B2

(12) United States Patent
Bailey et al.

(10) Patent No.: US 9,194,116 B2
(45) Date of Patent: Nov. 24, 2015

(54) CATCH BASIN FILTER

(76) Inventors: David Bailey, Rochester, WA (US); Leah Bailey, Rochester, WA (US)

( * ) Notice: Subject to any disclaimer, the term of this patent is extended or adjusted under 35 U.S.C. 154(b) by 659 days.

(21) Appl. No.: 13/507,793

(22) Filed: Jul. 30, 2012

(65) Prior Publication Data

US 2013/0118963 A1 May 16, 2013

Related U.S. Application Data

(60) Provisional application No. 61/558,496, filed on Nov. 11, 2011.

(51) Int. Cl.
*E03F 1/00* (2006.01)
*E03F 5/04* (2006.01)

(52) U.S. Cl.
CPC ..... *E03F 5/0404* (2013.01); *Y10T 137/0402* (2015.04)

(58) Field of Classification Search
None
See application file for complete search history.

(56) References Cited

U.S. PATENT DOCUMENTS 5,372,714 A 12/1994 Logue, Jr.
5,575,925 A 11/1996 Logue, Jr.
2013/0118963 A1* 5/2013 Bailey et al. ..... 210/164

OTHER PUBLICATIONS

Advertisement for ENPAC(R) Storm Sentinel Adjustable Catch Basin on Internet at URL http://benmeadows.com.
ENPAC Product No. 1341.

* cited by examiner

*Primary Examiner* — Robert James Popovics
(74) *Attorney, Agent, or Firm* — Brian J. Coyne

(57) ABSTRACT

A reusable, catch basin filter installable by one person into a catch basin. A blank of filter material is foldable to form a skirt with a central opening and having the shape of a flattened tube. A filter trap filter depends from the skirt. The hollow interior of the trap communicates with the central opening of the skirt. A flat, wire insert inserts into the skirt through an open, first end of the skirt. When installed in a catch basin, the wire insert prevents the filter from slumping as material accumulates within the filter trap. Upstanding fabric loops permit lifting a full or partially full filter out of a catch basin by carry poles or the forks of a fork lift truck inserted through the loops. After removing retained matter from the filter and cleaning the filter trap, the filter is ready for reuse.

16 Claims, 8 Drawing Sheets

CATCH BASIN FILTER

CROSS REFERENCE TO RELATED APPLICATIONS

This application claims the benefit of provisional application No. 61/558,496 by the same applicants for the same invention, filed on Nov. 11, 2011, the disclosure of which is incorporated herein.

STATEMENT REGARDING GOVERNMENT RESEARCH

Background of the Invention

1. Field of Invention

This invention pertains generally to a catch basin and more specifically to a catch basin filter bag that can be installed by one person.

2. Background Art

A catch basin is a receptacle, located where a street gutter opens into a storm drain, designed to retain matter that would not readily pass through the storm drainage system or is undesirable at the system outfall. Each catch basin typically has a recessed, horizontal, sealing surface near an upper end thereof and is provided with a removable cover grate that rests on said sealing surface. Each catch basin communicates with an adjacent storm drain through one or more outlet ports in a lower portion of the catch basin, whereby water flows from the catch basin into the storm drain. A catch basin filter is placed within a catch basin to retain matter that can accumulate within and clog the storm drainage system as well as to retain undesirable particulates that could end up in the outflow. Under current practice, when the filter is full with retained matter, the filter is lifted out of the catch basin, emptied, and a new filter is then installed in the catch basin.

There are several types of catch basin filters currently in use. Some catch basin filters use tape or other fasteners to hold the filter in place within a catch basin. Another type of filter has one or more pairs of oppositely disposed, oppositely-directed filter flaps that extend away from a centrally disposed, filter sock or trap portion of the filter. To install this kind of filter in an empty catch basin from which the grate has been removed, the trap portion is placed within the catch basin, and proximal portions of the flaps are draped over the sealing surfaces of the catch basin and the distal portions of the flaps are extended out over the adjacent street surface. The grate is then placed down over the proximal portions of the flaps so that it presses the proximal portions of the flaps onto, and overlies, said catch basin sealing surfaces. With the flaps thus extended over the street surface, the result can be unsightly. See, for example, U.S. Pat. No. 5,575,925. Moreover, these, and other catch basin filters currently in use, have the significant disadvantage that they require at least two persons working together to install a catch basin filter into a catch basin. Furthermore, since they are difficult to turn inside out for a thorough wash and cleaning after removal from a catch basin, as a practical matter such catch basin filters are not reusable.

SUMMARY OF THE INVENTION

The present invention solves the above-mentioned problems by providing a catch basin filter that is simple, effective, self-supporting, reusable, and easily installable in a catch basin by only a single person. The invention comprises a reusable, flat wire insert and a replaceable filter bag that is self-supporting when installed in a catch basin. The wire insert may be made from any appropriate material, but is optimally manufactured from suitably strong and durable, rust-resistant metal or plastic. The wire insert is shaped and dimensioned to be received within the hollow interior of a skirt portion of the catch basin filter, and the skirt itself is shaped and dimensioned to rest upon the horizontal sealing surface of a catch basin.

The wire insert has a central opening and includes a wire frame that defines the perimeter thereof. Since the horizontal sealing surface of a catch basin is ordinarily a rectangular annulus in top plan view, the wire frame of the wire insert is typically rectangular in top plan view, but can assume other geometric shapes as may be necessary to conform to the shape of the horizontal sealing surface of a particular catch basin. Optionally, additional wire elements can be included in the wire insert to strengthen and stabilize it and/or to define a central opening thereof.

The filter bag is also reusable and includes a generally flat skirt having a central opening, and, depending from the skirt, a generally wedge-shaped sock or filter trap that is closed at a bottom end thereof and open at a top end thereof. The skirt is comprised of a flexible, foldable, filter material. The filter material is chosen as one that retains particulate matter having major dimension equal to or greater than 2 millimeters within water and/or other liquids when passed through the material. The skirt is formed as a flattened tube that extends longitudinally from a first, open end to an opposite, closed, folded end and extends laterally from a third, closed, folded end to an opposite, fourth closed, folded end. The skirt is shaped and dimensioned to receive in surrounding engagement the wire insert when the wire insert is fully inserted through the first, open end thereof, such that, when fully inserted into the skirt, the wire frame is surrounded and engaged by the second, third and fourth folded ends of the skirt. When so inserted, the central opening of the skirt is aligned with the central opening of the wire insert and both openings communicate with the upper, open end of the filter trap.

Optionally, a plurality of upstanding D-rings (e.g., four D-rings) are distributed around the central opening of the skirt and are attached to an upper surface of the skirt. When the filter bag is installed within a catch basin, each of the D-rings is attached by cable ties to an overlying catch basin grate, thereby suspending the bag from the grate. To facilitate lifting a full or partially full filter out of a catch basin, the invention further includes two or more fabric loops and/or lift D-rings that are attached to the skirt on opposite sides of the central opening thereof. Hooks, carry rods, a pair of forks of a forklift truck, or any other appropriate tool can be inserted through the loops or carry D-rings to lift the bag up and away from the catch basin. This can be done either while the filter bag is still attached to the grate or after the grate has been disattached from the bag and removed from the catch basin. The D-rings will help keep the bag up tight to the grate so that the full capacity of the trap can be used to collect retained matter.

The invention includes a foldable blank of filter material for forming the skirt. In a preferred embodiment wherein the filter bag is intended for installation in a catch basin that has a sealing surface in the shape of a rectangular annulus of longitudinal length L and lateral width W, the foldable blank comprises a rectangular, central member defined by a first, lateral fold line of length L, a second, lateral fold line of length L that is laterally spaced a distance W apart from, and opposite, the first fold line; a third, laterally-disposed fold line of length W, and an opposite, laterally disposed fold line of length W; a first underfold member joined along the first fold line to the central member and an opposite, second underfold member joined along the second fold line to the central member; a third, underfold member joined along the third fold line to the central member and an opposite, fourth underfold member joined along the fourth fold line to the central member. The central member preferably has a circular, central opening having a diameter equal to the diameter of the top, open end of the trap. The third and fourth underfold members are preferably trapezoidal or rectangular and extend longitudinally away from the central member a distance x. So that the third and fourth underfold members, when folded under the central member will not extend over or occlude any portion of the central opening of the central member, the distance x is less than the distance y between the perimeter of the circular opening and the third and fourth fold lines. The first and second members each comprise a rectangle having lateral width less than or equal to the width W of the central member, except that from said rectangle a pair of parallel, laterally-directed recess edges have been cut out, which recess edges are conterminous with a semicircular cutout in said, respective members. Accordingly, when the first and second members are folded underneath the central member, the semicircular cutouts align with the perimeter of the circular opening of the central member. The open, tube-shape of the skirt is formed by folding under the central member, and securing to the central member (e.g., by sewing) the first, second and third fold members, but not the fourth fold member. Thus, when so folded and secured, the wire insert can be inserted through the front opening of the skirt and into the space between the central member and the underfolded first, second, and third members. After the wire insert has been fully inserted into the skirt, the fourth member can be folded underneath the wire insert between the wire insert and adjacent portions of the first and second members, thereby closing the front opening of the skirt. The result is that, when the catch basin filter bag of the present invention is installed in a catch basin, there are no unsightly flaps extending out over adjacent street surfaces. After a full filter bag has been lifted out of a catch basin, the filter trap is moved up, through, and above the aligned central openings of the wire insert and the skirt, and the fourth member is then pulled back out from underneath the wire insert, thereby restoring the front opening again to the skirt. The wire insert is then pulled out of the front opening of the skirt, ready for use again with either the same filter bag (after cleansing it) or with a new filter bag.

Therefore, it is an object of the invention to provide a catch basin filter comprising a filter bag and wire insert that can be installed in a catch basin by a single person only.

It is a further object of the invention to provide the filter bag portion of said filter with a tube-shaped skirt shaped and dimensioned to rest on the sealing surface of a catch basin and to provide a reusable, wire insert that is insertable into said skirt to assist in preventing the filter from slumping down into the catch basin as retained matter accumulates within the filter.

Another object of the invention is to provide said filter bag with a hollow, wedge-shaped trap suspended from said skirt, which trap has a hollow interior that communicates with a central opening in said skirt.

A further object of the invention is to provide such a filter that, by suspension by D-rings and cable ties or the like from a grate resting on the sealing surface of a catch basin, is further prevented from slumping down into the catch basin as retained matter accumulates within the filter.

Still another object of the invention is to provide such a filter having a filter bag that can be turned inside out to facilitate cleansing and reuse of the bag.

A further object is to provide said filter with upstanding, fabric loops, lift D-rings, or the like to facilitate lifting said filter out of a catch basin.

These and other objects of the invention will be apparent to persons of ordinary skill in the art of manufacture and use of catch basin filters from the detailed description, drawings and appended patent claims, as set forth below.

BRIEF DESCRIPTION OF THE DRAWINGS

Similar numerals designate similar component parts and aspects of the invention throughout the several views. Cable ties are illustrated in FIG. 7, but are omitted from the remaining drawings for the sake of clarity.

DETAILED DESCRIPTION OF THE INVENTION

Figure 1:
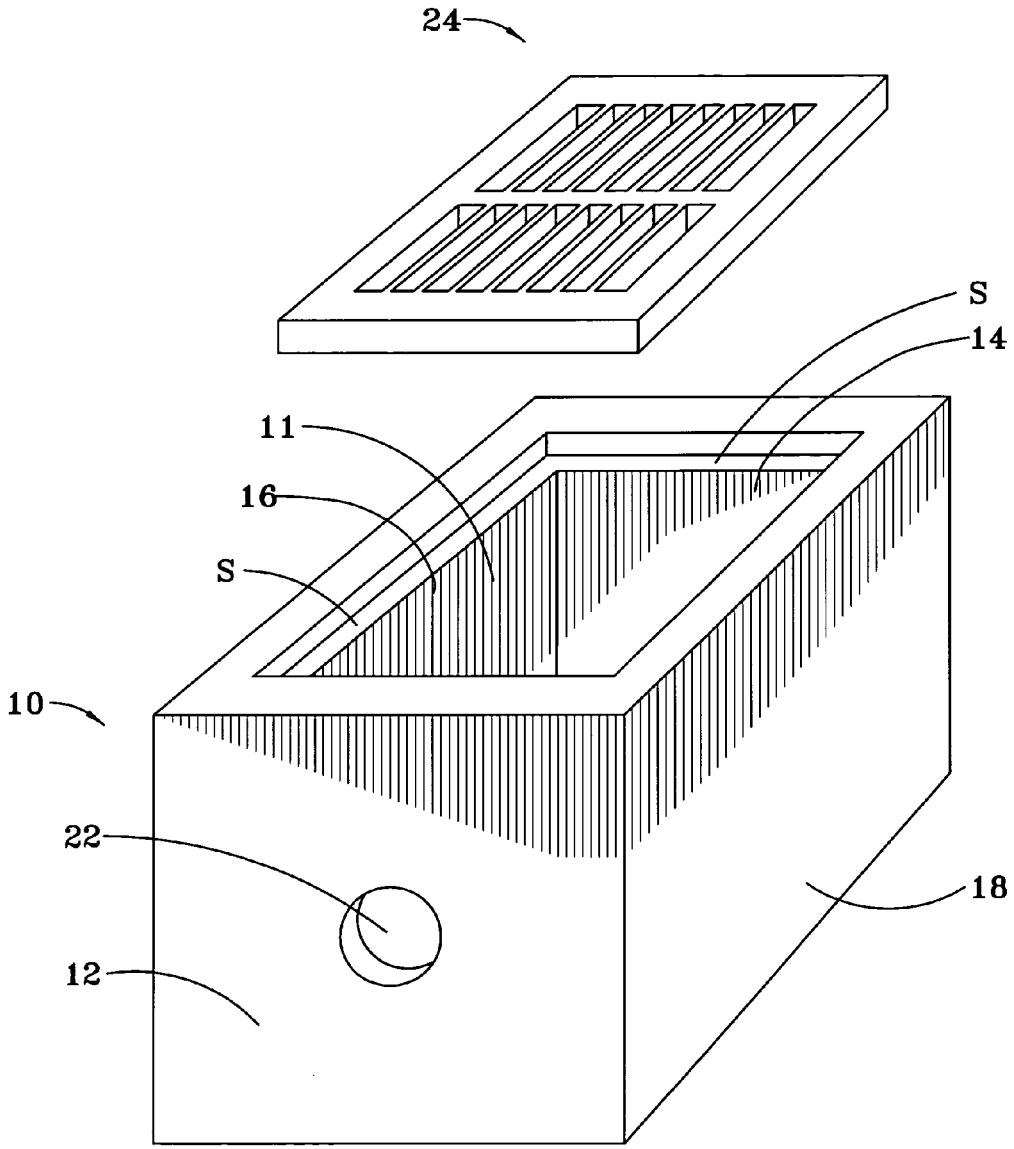
FIG. 1 (PRIOR ART)
FIG. 1 is top, perspective view of a catch basin and grate.
Figure 2:
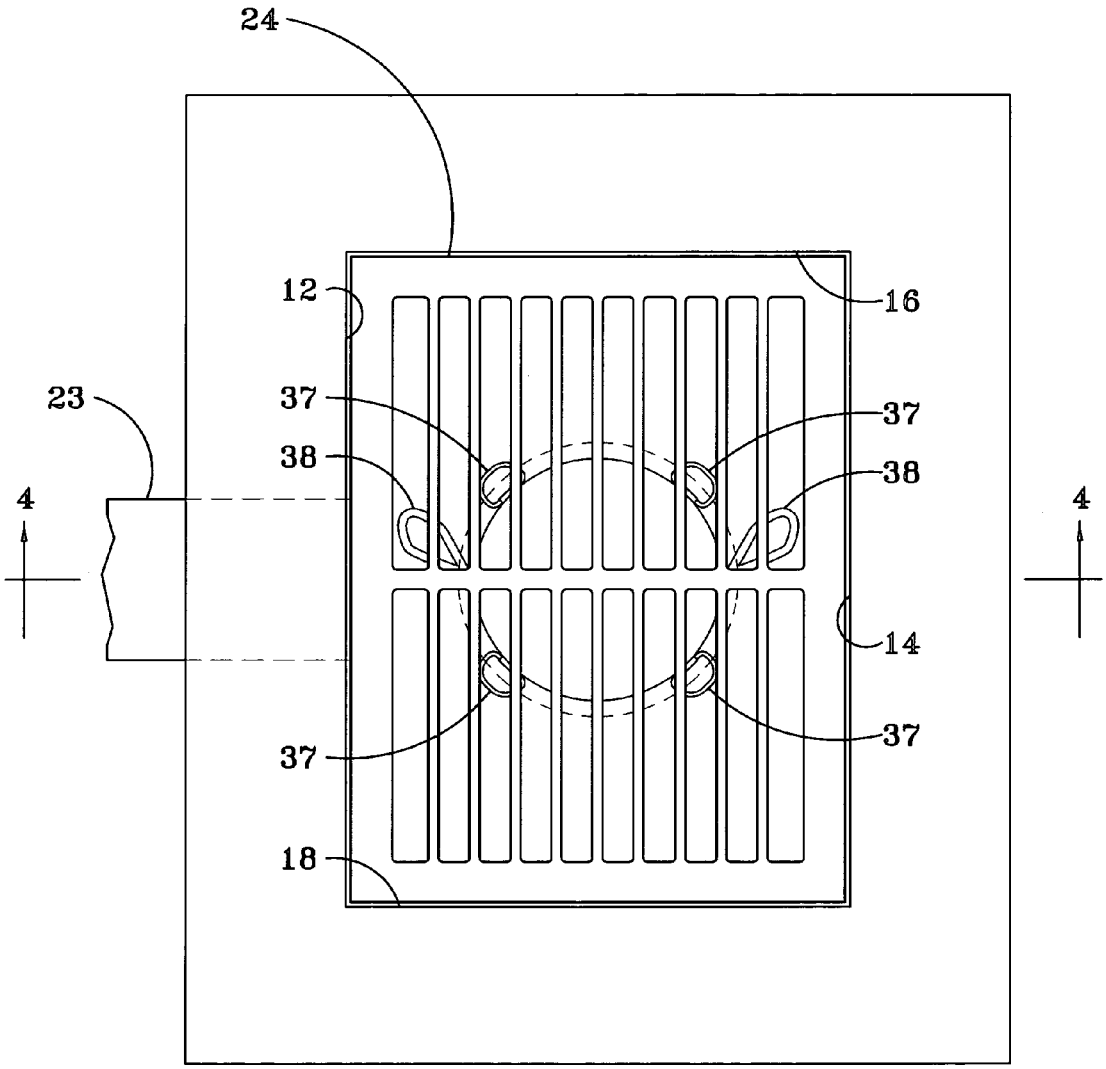
FIG. 2 is a top, plan view of a preferred embodiment of the invention shown installed in a catch basin and covered by a catch basin grate.

FIG. 1 depicts a catch basin 10 comprising a pair of longitudinally spaced apart, vertical end walls 12, 14 joined by a pair of laterally spaced apart, vertical side walls 16, 18, which vertical walls, in combination with a horizontal, bottom wall 19 that joins lower end portions of said vertical walls, define a hollow, interior space 11 of the catch basin. Approximately the top two vertical inches of the inner surfaces of the vertical walls 12, 14, 16, 18 are recessed, thereby creating a horizontal shoulder on each of said walls. Together, the horizontal shoulders of the walls 12, 14, 16, 18 comprise a sealing surface S having the shape of a rectangular annulus. The catch basin 10 has at least one outlet port 22 to permit water to flow from the catch basin through an outflow pipe 23 into an adjacent storm drain (not shown). A removable catch basin grate 24, depicted in FIG. 1 as raised above the catch basin 10, when lowered down onto the catch basin (arrow 59) rests on the sealing surface S and fits snugly within the recessed, inner surfaces of the vertical walls 12, 14, 16, 18; see, for example, FIG. 2.

Figure 3:
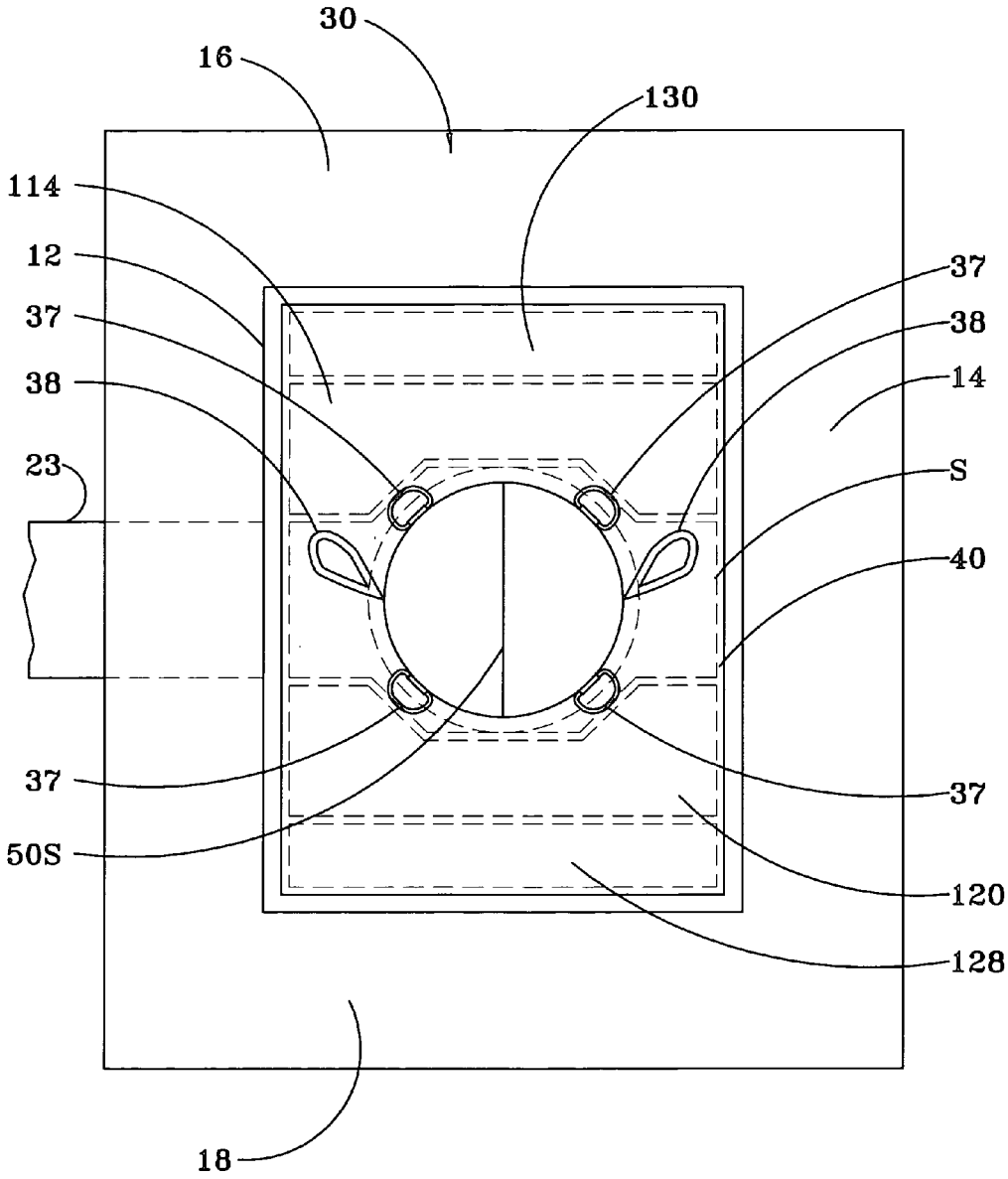
FIG. 3 is a top, plan view thereof with the grate removed and with the wire insert depicted in phantom outline.
Figure 4:
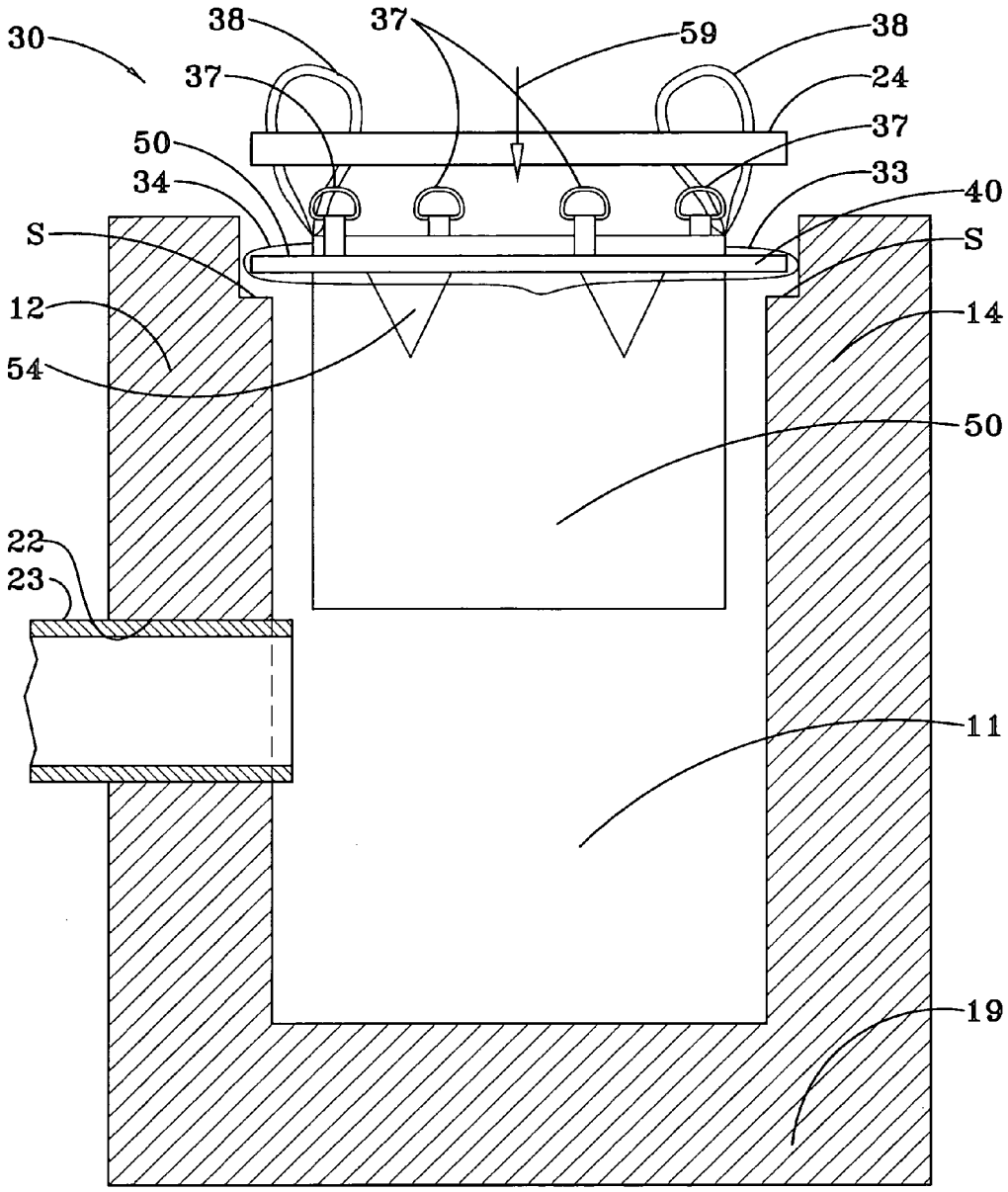
FIG. 4 is a vertical, cross-sectional view thereof taken along line 4-4 of FIG. 2.
Figure 5:
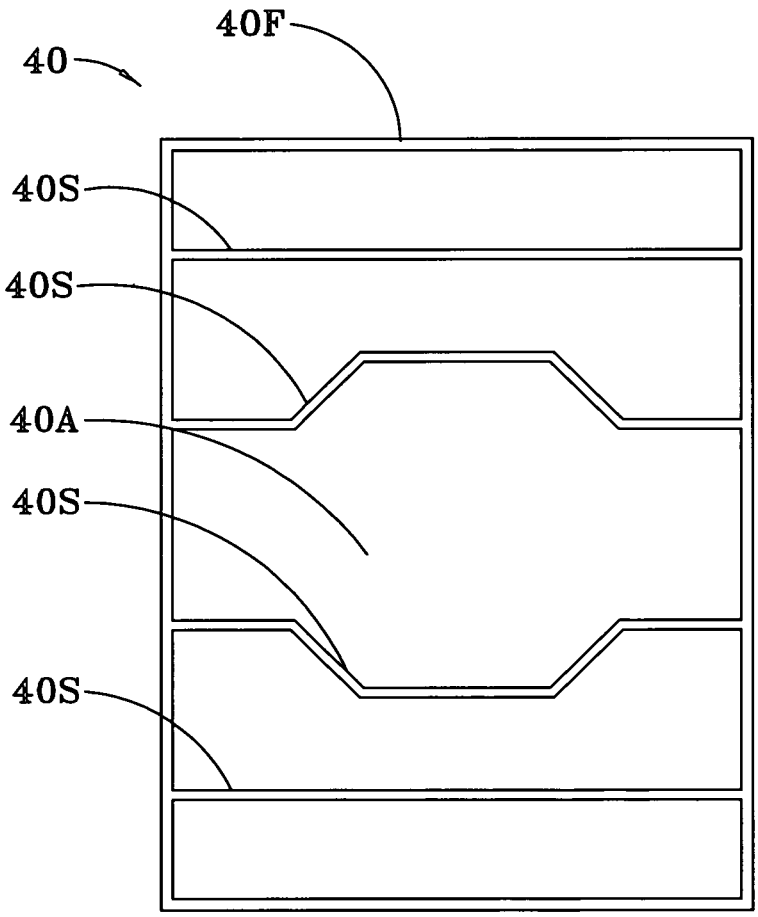
FIG. 5 is a top, plan view of a wire insert removed therefrom.

Referring now to FIGS. 3 and 4, a preferred embodiment of a catch basin filter 30 according to the present invention is depicted installed in a catch basin 10. The catch basin filter 30 comprises four main components: a skirt 32, a removable wire insert 40 that is insertable into the skirt, a filter trap 50 that depends from the skirt, means attached to the skirt for suspending the skirt from the catch basin grate 24, and lift means 38 attached to the skirt for facilitating lifting a catch basin filter installed in a catch basin up and out of the catch basin.

Figure 6:
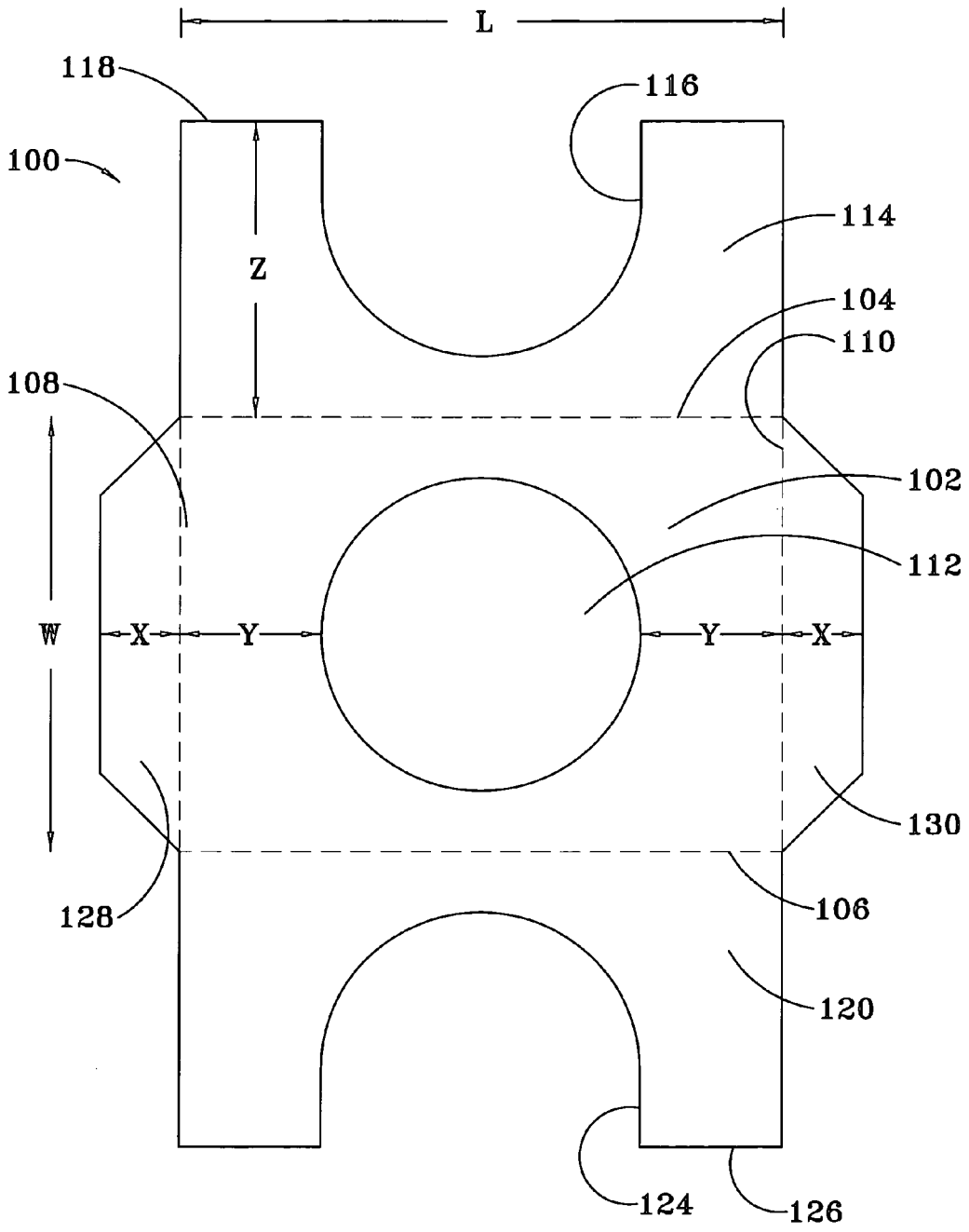
FIG. 6 is a top, plan view of a blank comprising a sheet of filter material that is foldable to form a skirt portion of the filter bag of the invention (the trap portion is omitted) with dashed lines depicting the fold lines.

The skirt 32 is comprised of a folded, filter material and has the shape of a flattened tube. The skirt 32 extends longitudinally from a first end 33 to an opposite, closed, folded end 34, and extends laterally from a third, closed, folded end 35 to an opposite, fourth folded end 36. The first end 33 is alternately foldable and unfoldable between a closed and an open condition, respectively. Referring to FIG. 6, the skirt is formed by folding a blank 100 having first and second underfold members 114, 120 oppositely joined to a central member 102 that, when folded along fold lines 104, 106 under the central member form the third and fourth folded ends 35, 36, respectively. Similarly, the blank further includes third and fourth underfold members 128, 130 oppositely attached to the central member that, when folded along fold lines 108, 110 under the central member, form the first and second folded ends 33, 34 of the skirt 32. The skirt 32 has a central opening 112 through which surface runoff water from adjacent street surface flows, and thence down into the hollow interior space 51 of the filter trap 50 below. The central opening 112 may be circular as depicted in the drawings or can be rectangular, oval or other geometric shape. Thus, the open, tube-shape of the skirt 32 is formed by permanently folding under the central member 102, and by permanently securing to the central member (e.g., by sewing or adhesive), the first fold member 114, the second fold member 120, and the third fold member 128 (but not the fourth fold member 130).

Figure 7:
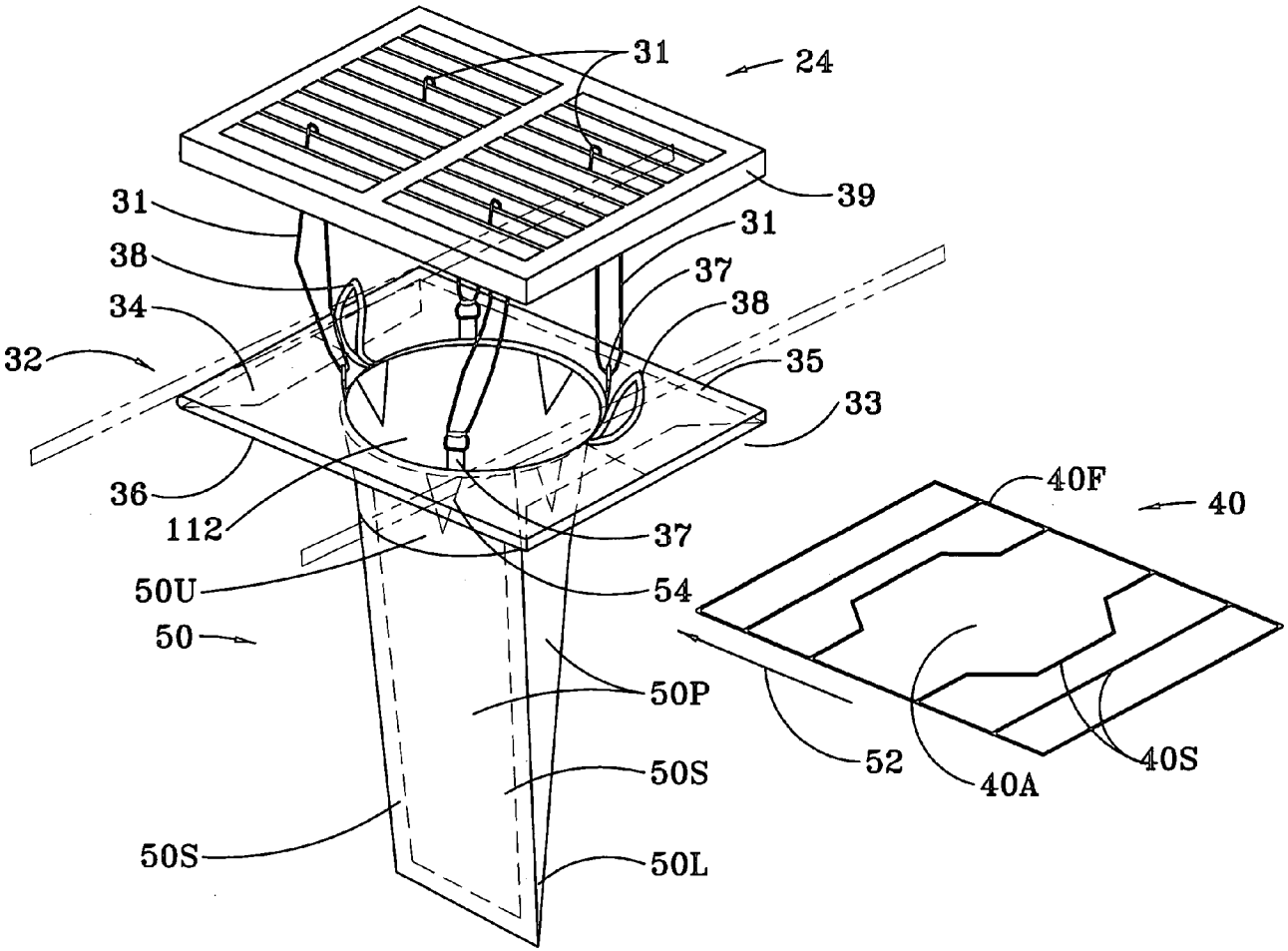
FIG. 7 is a perspective view of the invention as it appears prior to installation into a catch basin and with the wire insert thereof removed and aligned for insertion into the front opening of the skirt.
Figure 8:
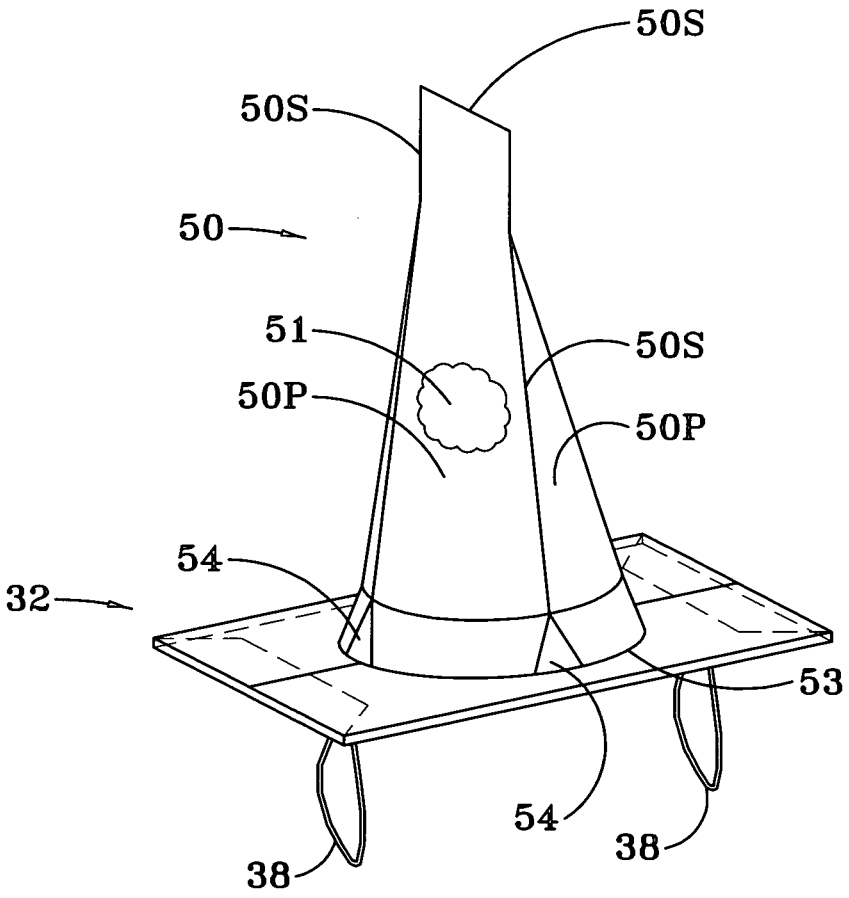
FIG. 8 is an inverted, perspective view of the invention as it appears prior to installation into a catch basin with a portion of the filter trap portion cut away to display the hollow interior thereof.

A filter trap 50, comprised of a filter material, depends from the skirt 32. The filter trap 50 has a hollow interior 51 and extends down from an open, upper end 50U thereof to a closed lower end 50L thereof, said hollow interior 51 communicating through said open, upper end with the central opening 112 of the skirt 32. The filter trap 50 may be formed by sewing or otherwise joining together along a continuous, U-shaped seam 50S the matching, peripheral edge portions of two identical panels 50P of filter material. So constructed, as depicted in FIG. 7, the panels 50P taper inward towards each other from the open, upper end 50U to the lower ends 50L thereof, so that the filter trap 50 appears wedge-shaped when the U-shaped seam 50S is viewed end-on in the direction of the arrow 52. Preferably, as depicted in the drawings, the open, upper end 50U of the filter trap 50 is shaped and dimensioned to match the shape and dimensions of the central opening 112 of the skirt 32 and is sewn or otherwise joined to the skirt at their line of juncture 53. A plurality of overflow openings 54 are cut out of an upper portion of the filter trap 50; preferably, the overflow openings are triangular, equally spaced apart about the open, upper end 50U, and four in number.

The catch basin filter 30 further includes a removable, flat, wire insert 40 that is insertable into the skirt 32. The wire insert 40 is shaped and dimensioned for full insertion into the interior of the skirt 32 through an open, first end 33 of the skirt such that, when so inserted, the wire insert is received in surrounding engagement by the skirt and helps to support the catch basin filter in position when installed within a catch basin 10, and without sagging as material accumulates in the filter trap 50. The wire insert 40 includes a wire frame 40F and preferably includes reinforcing, cross struts 40S attached to the frame that define a central opening 40A of the wire insert. Preferably, the wire insert frame 40F comprises 8 gauge, zinc-plated, steel wire, and the wire struts 40S are formed from 10 gauge, zinc-plated, steel wire. When fully inserted within the skirt 32 the central opening 40A of the wire insert is aligned with the central opening 112 of the skirt 32. To help maintain the wire insert 40 within the skirt 32, the first end 33 of the skirt is closed around the wire insert by tucking the fourth, underfold member under the wire insert and between the wire insert and the first and second, underfold members 114, 120. After the catch basin filter 30 has been removed from a catch basin 10, the wire insert 40 can be removed from the skirt 32 by moving the filter trap 50 up, through, and above the aligned central openings 40A, 112 of the wire insert 40 and the skirt 32, respectively, pulling the fourth, underfold member 130 out from underneath the wire insert, and then pulling the wire insert out of the interior of the skirt 32 through the first, open end 33 of the skirt. After removing the accumulated material from the catch basin filter 30, for example by turning the filter trap 50 inside out and washing it, the wire insert 40 can be reinserted into the skirt 32 of the same catch basin filter 30 or it can be used with the skirt 32 and filter trap 50 of a new catch basin filter. If the same filter 30 is to be reused, after fully inserting the wire insert into the interior of the skirt 32, the fourth, underfold member 130 is again tucked underneath the wire insert, thereby closing the first end 33 of the skirt, and the cleaned filter trap 50 is pushed back down through the aligned central openings 40A, 112 of the wire insert 40 and the skirt 32, respectively, ready to be installed again in a catch basin 10.

The catch basin filter 30 further includes means for lifting it out of a catch basin 10 after material has accumulated in the filter trap 50. To that end, two or more upstanding fabric loops 38 are attached to the skirt 32 on opposite sides of the central opening 112 of the skirt; alternatively, carry b-rings (not shown) can be substituted for the fabric loops. A pair of carry poles 39 (FIG. 7, phantom outline) are insertable through the fabric loops 38 for lifting the catch basin filter 30; alternatively, the forks of a fork lift truck may be inserted through the fabric loops.

The filter material that comprises the skirt 32 and the filter trap 50 preferably retains solid particulate matter having major dimension 2 millimeters or greater; such filter material is available, for example, from Atlantic Construction Fabric, Inc., of Portland, Oreg. The wire insert 40 and D-rings 37 are comprised of a rigid, rust-resistant metal or plastic. The D-rings 37 are attachable to a catch basin grate 24 by cable ties 31 or other cord-like fasteners having adequate strength and durability for the purpose. Thus, it should be evident that a catch basin filter according to the concepts of the present invention has been shown and described in sufficient detail to enable one of ordinary skill in the art to practice the invention. Since various modifications in detail, materials, arrangements of parts, and equivalents thereof, are within the spirit of the invention herein disclosed and described, the scope of the invention should be limited solely by the scope of the appended patent claims.

What is claimed is:

1. A catch basin filter for use with a catch basin and a grate, said catch basin having an inlet through which water and solids flow into the catch basin, an outlet through which water flows out of the catch basin, wherein the inlet is positioned above the outlet, said catch basin having a recessed sealing surface at the inlet that is shaped and dimensioned for receiving and supporting said grate within said upper portion of said catch basin, wherein the catch basin filter comprises:

a) a filter bag shaped and dimensioned to be received in the catch basin for retaining the solids that enter the catch basin through an inlet of the catch basin, said bag including (1) a skirt comprised of folded, filter material and having the shape of a flattened tube, which skirt extends longitudinally from a first end to an opposite, closed, folded end, and extends laterally from a third, closed, folded end to an opposite, fourth folded end, said first end being alternately foldable and unfoldable between a closed and an open condition, respectively, and the skirt having a central opening; and (2) attached to and depending from the skirt, a filter trap having a hollow interior and extending down from an open, upper end thereof to a closed lower end thereof, said hollow interior communicating through said open, upper end with the central opening of the skirt;

b) a flat, wire insert, wherein said insert (1) is shaped and dimensioned to be received in surrounding engagement by the skirt when the first end of the skirt is unfolded to an open condition and the insert is fully inserted into the skirt through said first, open end, and can thereafter be withdrawn from the skirt through said first, open end for reuse with the same or another filter bag; and (2) has a central opening that aligns and communicates with the central opening of the skirt when the insert is fully inserted into the skirt; and c) two or more upstanding fabric loops or carry D-rings attached to the skirt at opposite sides of the central opening of the skirt.

2. The catch basin filter of claim 1, wherein the wire insert includes a wire frame that defines the perimeter thereof.

3. The catch basin filter of claim 2, wherein the filter trap is wedge-shaped, being tapered from a relatively wide top end to a relatively narrow lower end thereof.

4. The catch basin of claim 1, wherein the top, open end of the filter trap is circular and the skirt is formed by folding a blank comprised of foldable filter material, said blank comprising:

(a) a rectangular, central member, wherein (1) the central member is defined by a first, longitudinal, fold line of length L, a second, longitudinal fold line of length L that is laterally spaced a distance W apart from, parallel to, and opposite, the first fold line; a third, lateral fold line of length W, and a fourth, lateral fold line of length W that is spaced a distance L apart from, parallel to, and opposite, the third fold line; and (2) the central member has a circular, central opening with diameter equal to the diameter of the top, open end of the trap;

(b) a first underfold member joined along the first fold line to the central member; said member having a recessed cutout in a peripheral edge thereof such that when said member is folded under the central member along the first fold line said recessed cutout aligns with an overlying semicircular portion of the circular, central opening of the central member;

(c) a second underfold member disposed opposite to the first underfold member 114 and joined along the second fold line to the central member, said member having a recessed cutout in a peripheral edge thereof such that when said member is folded under the central member along the second fold line said recess cut aligns with an overlying, semicircular portion of the circular, central opening of the central member;

(d) a third, underfold member joined along the third fold line to the central member; and (e) a fourth underfold member disposed opposite to the third underfold member and joined along the fourth fold line to the central member.

5. The catch basin filter of claim 4, wherein the first and second underfold members extend laterally away from the first and second fold lines, respectively, at most a distance x that is less than or equal to W.

6. The catch basin filter of claim 5, wherein the third and fourth underfold members are trapezoidal or rectangular and extend longitudinally away from the central member a distance x that is less than the least distance y between the central opening of the blank and the third and fourth fold lines, respectively, whereby the third and fourth underfold members, when folded under the central member, will not extend over any portion of the central opening of the central member.

7. The catch basin filter of claim 6, wherein an upper portion of the filter trap has a plurality of overflow openings.

8. The catch basin filter of claim 1, further comprising a plurality of upstanding D-rings distributed around the central opening of the skirt and attached to the skirt.

9. A method of installing a catch basin filter in a catch basin below a catch basin grate, said catch basin comprising:

an inlet through which water and solids flow into the catch basin, an outlet through which water flows out of the catch basin, wherein the inlet is positioned above the outlet, a pair of longitudinally spaced apart, vertical end walls joined by a pair of laterally spaced apart, vertical side walls, which vertical walls, in combination with a horizontal, bottom wall that joins lower end portions of said vertical walls, define a hollow, interior space of the catch basin, each of said vertical walls being recessed at the inlet, thereby forming a horizontal sealing surface shaped and dimensioned to receive and support said grate, and the filter comprising:

a) a filter bag shaped and dimensioned to be received in the catch basin for retaining the solids that enter the catch basin through the inlet of the catch basin, said bag including (1) a skirt comprised of folded, filter material and having the shape of a flattened tube, which skirt extends longitudinally from a first end to an opposite, closed, folded end, and extends laterally from a third, closed, folded end to an opposite, fourth folded end, said first end being alternately foldable and unfoldable between a closed and an open condition, respectively, and the skirt having a central opening; and (2) attached to and depending from the skirt, a filter trap having a hollow interior and extending down from an open, upper end thereof to a closed lower end thereof, said hollow interior communicating through said open, upper end with the central opening of the skirt;

b) a flat, wire insert, wherein said insert (1) is shaped and dimensioned to be received in surrounding engagement by the skirt when the first end of the skirt is unfolded to an open condition and the insert is fully inserted into the skirt through said first, open end, and can thereafter be withdrawn from the skirt through said first, open end for reuse with the same or another filter bag; and (2) has a central opening that aligns and communicates with the central opening of the skirt when the insert is fully inserted into the skirt; and c) two or more upstanding fabric loops or carry D-rings attached to the skirt at opposite sides of the central opening of the skirt; and said method comprising the steps of:

(1) moving the filter trap up and through the central opening of the skirt until the filter trap is fully extended above said central opening;

(2) unfolding the first end of the skirt to an open condition;

(3) fully inserting the wire insert into the open, first end of the skirt;

(4) folding the first end of the skirt around and underneath the wire insert, thereby closing said first end of the skirt;

(5) moving the filter trap back down and through the central opening of the skirt and through the central opening of the insert as far as it will extend downward therefrom;

(6) inserting the filter trap into the hollow, interior space of the catch basin and lowering it therein until the skirt comes to rest upon said horizontal, sealing surface; and (7) placing the grate over the skirt within said recesses of said vertical walls of said catch basin.

10. The method of claim 9, wherein the wire insert includes a wire frame that defines the perimeter thereof.

11. The method of claim 10, wherein the filter trap is wedge-shaped, being tapered from a relatively wide top end to a relatively narrow lower end thereof.

12. The method of claim 11, wherein said catch basin filter further comprises a plurality of upstanding D-rings distributed around the central opening of the skirt and attached to the skirt, and said method further comprises the step of attaching the D-rings to the grate by fasteners such as cable ties or the like prior to step (7) of claim 9.

13. The method of claim 12, wherein the top, open end of the filter trap is circular and the skirt is formed by folding a blank comprised of foldable filter material, said blank comprising:

(a) a rectangular, central member, wherein (1) the central member is defined by a first, longitudinal, fold line of length L, a second, longitudinal fold line of length L that is laterally spaced a distance W apart from, parallel to, and opposite, the first fold line; a third, lateral fold line of length W, and a fourth, lateral fold line of length W that is spaced a distance L apart from, parallel to, and opposite, the third fold line; and (2) the central member has a circular, central opening with diameter equal to the diameter of the top, open end of the trap;

(b) a first underfold member joined along the first fold line to the central member; said member having a recessed cutout in a peripheral edge thereof such that when said member is folded under the central member along the first fold line said recessed cutout aligns with an overlying semicircular portion of the circular, central opening of the central member;

(c) a second underfold member disposed opposite to the first underfold member and joined along the second fold line to the central member, said member having a recessed cutout in a peripheral edge thereof such that when said member is folded under the central member along the second fold line 106 said recess cut aligns with an overlying, semicircular portion of the circular, central opening of the central member;

(d) a third, underfold member joined along the third fold line to the central member; and (e) a fourth underfold member disposed opposite to the third underfold member and joined along the fourth fold line to the central member.

14. The method of claim 13, wherein the first and second underfold members extend laterally away from the first and second fold lines, respectively, at most a distance x that is less than or equal to W.

15. The method of claim 14, wherein the third and fourth underfold members are trapezoidal or rectangular and extend longitudinally away from the central member a distance x that is less than the least distance y between the central opening of the blank and the third and fourth fold lines, respectively, whereby the third and fourth underfold members, when folded under the central member, will not extend over any portion of the central opening of the central member.

16. The method of claim 15, wherein an upper portion of the filter trap has a plurality of overflow openings spaced apart about the open, upper end thereof.

* * * * *